US006045013A

United States Patent [19]

Yang

[11] Patent Number: 6,045,013

[45] Date of Patent: Apr. 4, 2000

[54] CONTAINER CONTAINING LIQUID OR THE LIKE THEREIN

[76] Inventor: Ming-Te Yang, No. 31, Cheng-Kuang Rd., Chung-Hsiao Li, Cheng-Kung Chen, Taitung Hsien, Taiwan

[21] Appl. No.: 09/167,584

[22] Filed: Oct. 7, 1998

[51] Int. Cl.[7] ..... B67D 3/00

[52] U.S. Cl. ..... 222/510; 222/530; 222/538; 222/484; 222/481.5; 137/587; 137/347

[58] Field of Search ..... 222/481.5, 461, 222/462, 482, 510, 530, 484, 538, 465.1; 251/273, 264, 284, 318, 333; 137/587, 347

[56] References Cited

U.S. PATENT DOCUMENTS

| | | | |
|---|---|---|---|
| 1,343,921 | 6/1920 | Klingman | 222/538 |
| 1,398,025 | 11/1921 | James | 222/510 |
| 1,579,390 | 4/1926 | Peaden | 222/482 |
| 5,400,928 | 3/1995 | Resnick | 222/530 |

FOREIGN PATENT DOCUMENTS

| | | | |
|---|---|---|---|
| 002658164 | 8/1991 | France | 222/510 |

*Primary Examiner*—Kevin Shaver
*Assistant Examiner*—David A Bonderer
*Attorney, Agent, or Firm*—Rosenberg, Klein & Lee

[57] ABSTRACT

A liquid container includes a hollow body containing an outlet hole formed in the bottom portion thereof, a V-shaped control valve mounted on the bottom portion of the body and having a first tube received in the body and a second tube extending outward from the body via the outlet hole, a plurality of drain holes contained in the mediate portion of the control valve and connecting between the body and the second tube, a control gasket movably mounted in the control valve and movable between a first position where the control gasket seals each of the drain holes, thereby closing the connection between the body and the second tube, and a second position where the control gasket is released from the drain holes, thereby opening the connection between the body and the second tube, and a drive device for moving the control gasket between the first position and the second position.

11 Claims, 11 Drawing Sheets

CONTAINER CONTAINING LIQUID OR THE LIKE THEREIN

CROSS-REFERENCES TO RELATED APPLICATIONS

Not Applicable.

BACKGROUND OF THE INVENTION

1. Field of the Invention

The present invention relates to a liquid container.

2. Description of the Related Art

A conventional portable liquid container used for storing liquid such as water therein includes a container body, a handgrip mounted on the top portion of the container body, a vent formed on the top portion of the container body, and an outlet port formed on the bottom portion of the container body. It is necessary to provide a control device to synchronously control the opening/closing operation of the vent and the outlet port. The present invention has arisen to provide a liquid container with a control device which synchronously controls the opening/closing operation of the vent and the outlet port.

BRIEF SUMMARY OF THE INVENTION

In accordance with one aspect of the present invention, there is provided a liquid container comprising a hollow body containing an outlet hole formed in the bottom portion thereof, a substantially V-shaped control valve mounted on the bottom portion of the body and including a first tube received in the body and a second tube extending outward from the body via the outlet hole, and a plurality of drain holes contained in the mediate portion of the control valve and connecting between the body and the second tube, a control gasket movably mounted in the control valve and movable between a first position where the control gasket seals each of the drain holes, thereby closing the connection between the body and the second tube, and a second position where the control gasket is released from the drain holes, thereby opening the connection between the body and the second tube, and drive means for moving the control gasket between the first position and the second position.

Further benefits and advantages of the present invention will become apparent after a careful reading of the detailed description with appropriate reference to the accompanying drawings.

DETAILED DESCRIPTION OF THE INVENTION

Figure 1:
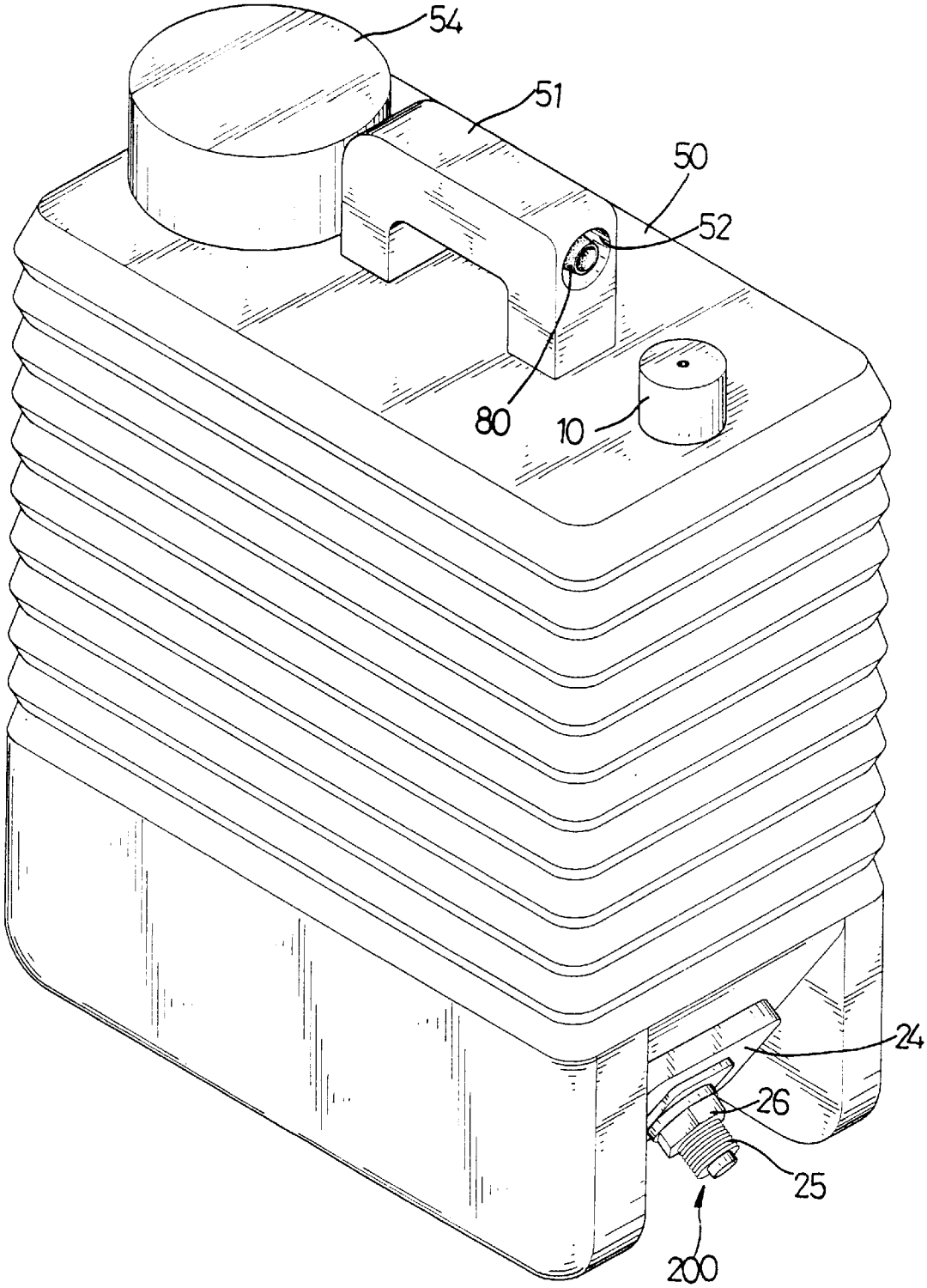
FIG. 1 is a perspective view of a liquid container in accordance with the present invention.
Figure 2:
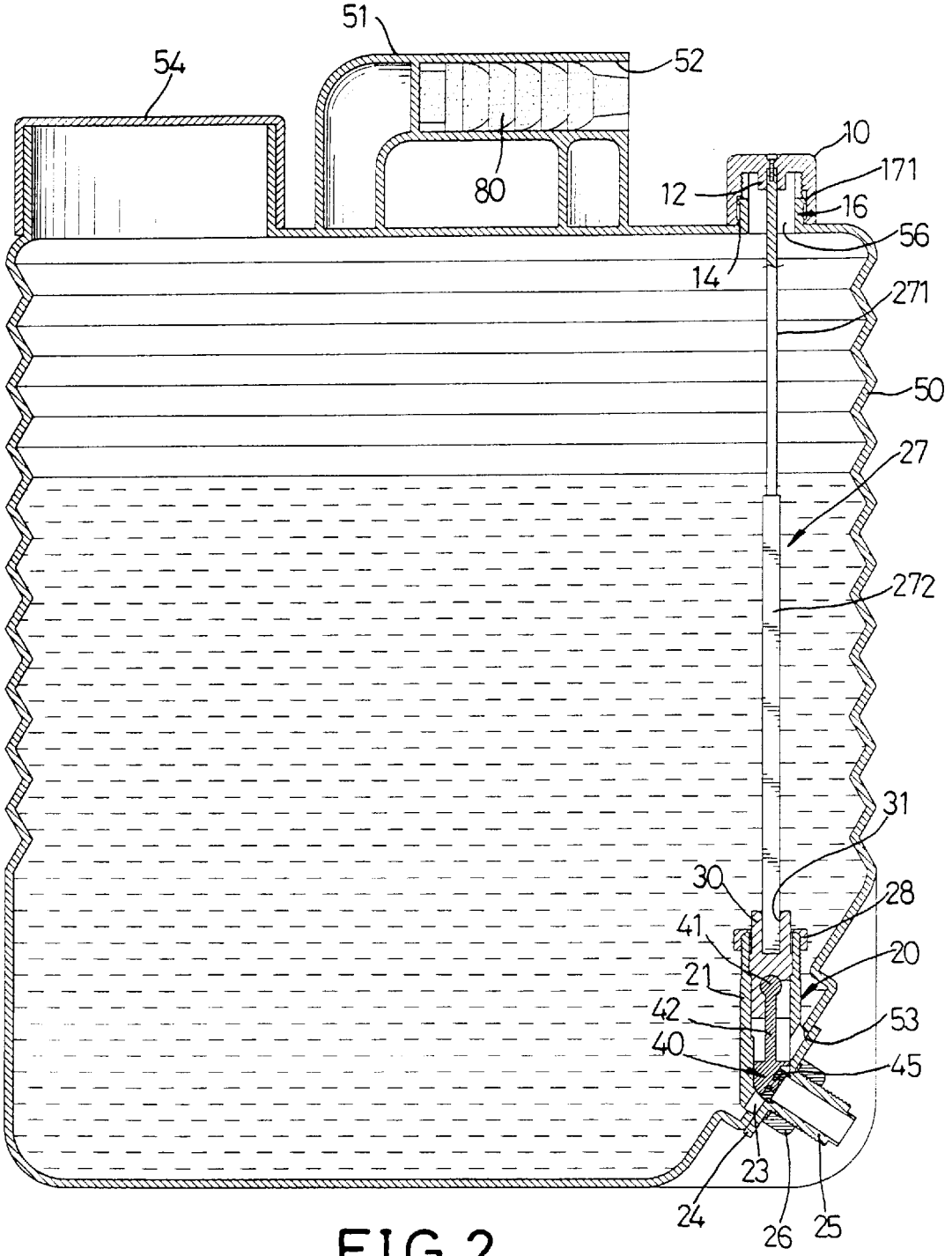
FIG. 2 is a front plan cross-sectional view of the liquid container as shown in FIG. 1.
Figure 3:
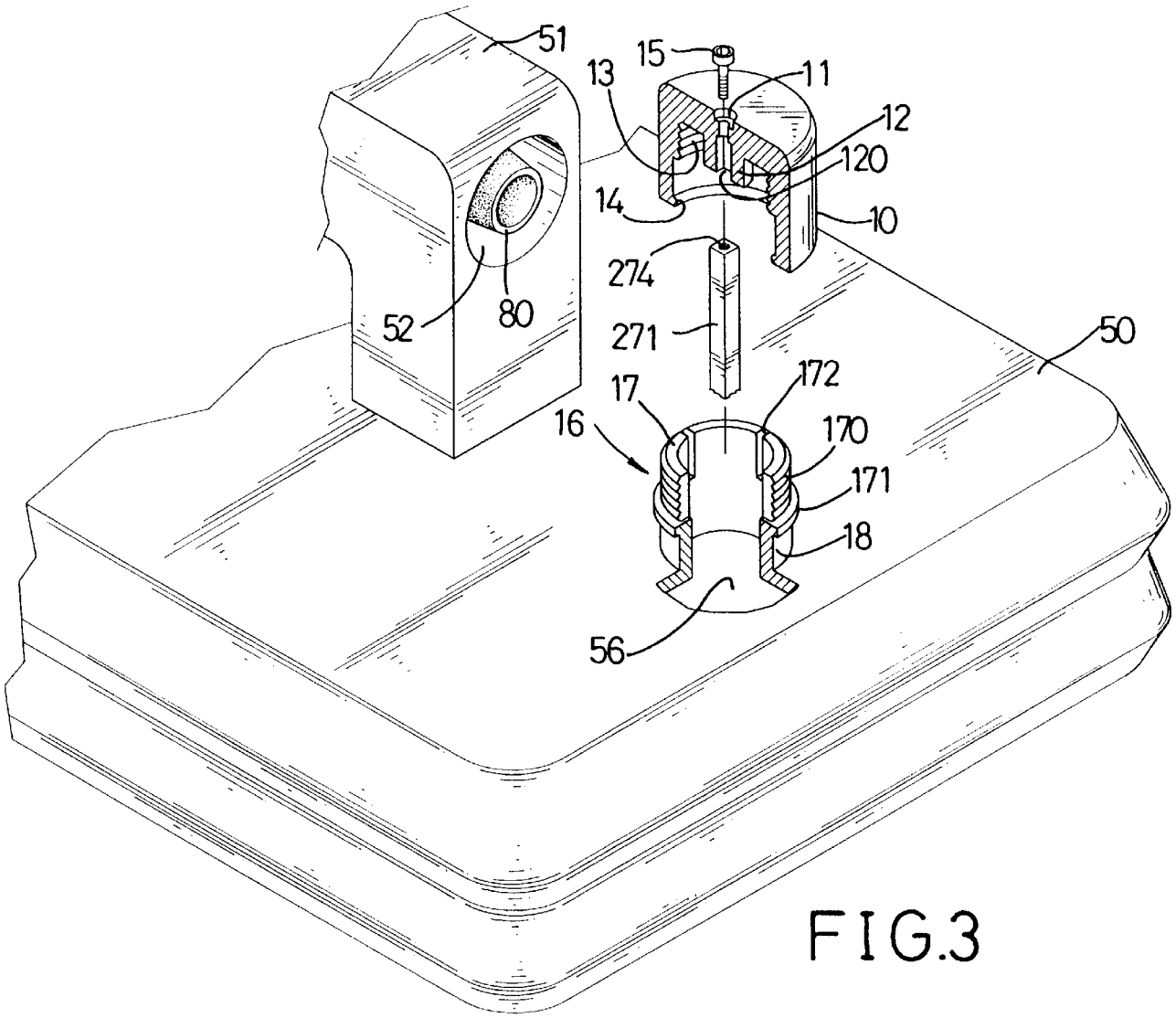
FIG. 3 is a partially exploded perspective view of the liquid container as shown in FIG. 1.
Figure 4:
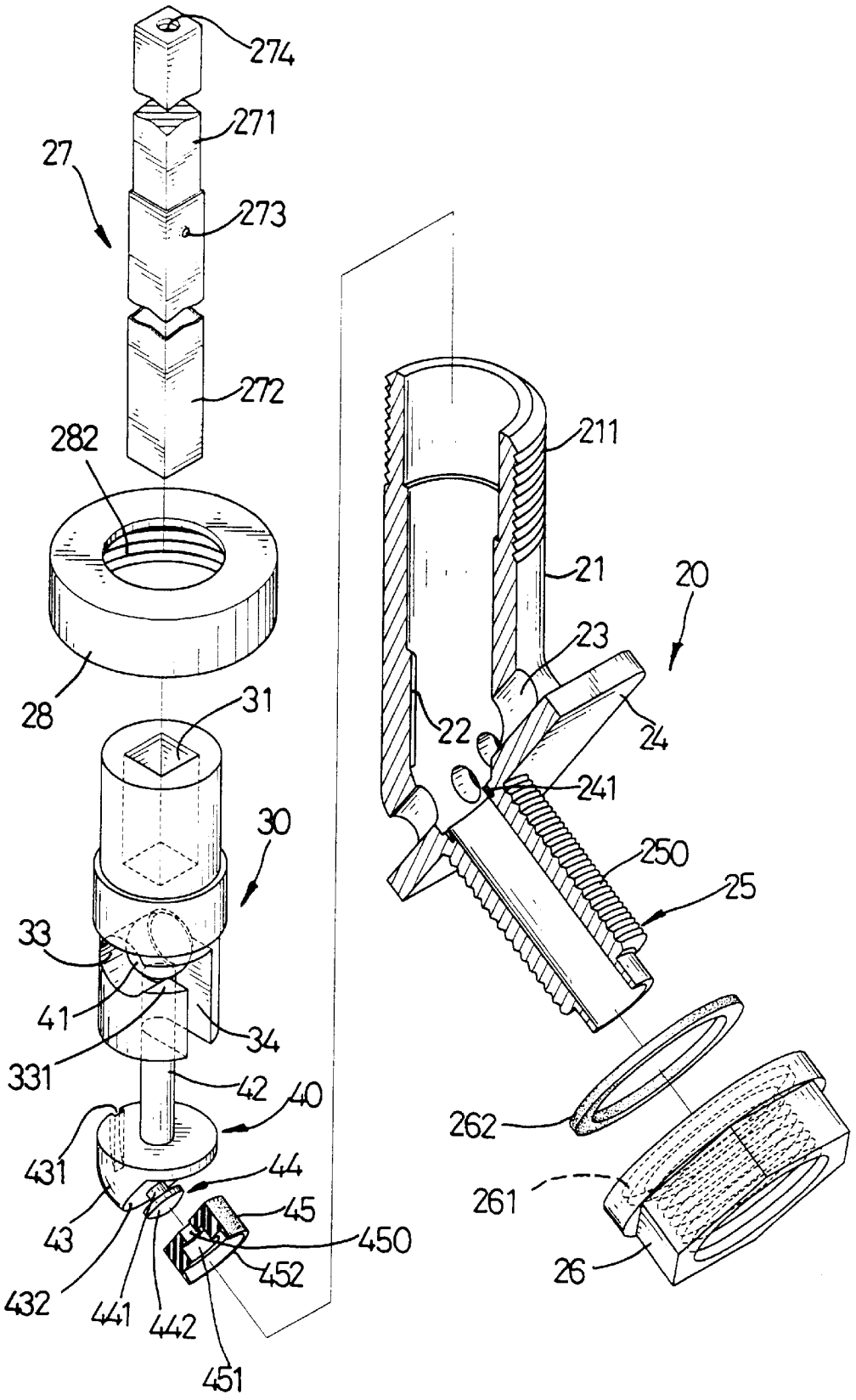
FIG. 4 is a partially exploded view of the liquid container valve as shown in FIG. 1.

Referring to the drawings and initially to FIGS. 1–6, a liquid container in accordance with the present invention comprises a hollow body (50) containing an vent hole (56) formed in the top portion thereof and an outlet hole (53) formed in the bottom portion thereof, a substantially V-shaped control valve (20) mounted on the bottom portion of the body (50) and including a first tube (21) received in the body (50) and a second tube (25) extending outward from the body (50) via the outlet hole (53), and a plurality of drain holes (23) contained in the mediate portion of the control valve (20) and connecting between the body (50) and the second tube (25), a control gasket (45) movably mounted in the control valve (20) and movable between a first position where the control gasket (45) seals each of the drain holes (23), thereby closing the connection between the body (50) and the second tube (25), and a second position where the control gasket (45) is released from the drain holes (23), thereby opening the connection between the body (50) and the second tube (25), and a drive device for moving the control gasket (45) between the first position and the second position.

An inverted U-shaped handle (51) is mounted on the top portion of the body (50) and transversely contains a storage chamber (52) for releasably receiving a bellows pipe (80) therein.

The drive device comprises a tubular lug (16) fixedly mounted on the top portion of the body (50) and connecting to the vent hole (56), an end cap (10) rotatably mounted on the lug (16) and movable relative to the lug (16), a drive member (27) movably received in the body (50) and including an upper portion secured to the end cap (10) to rotate and move therewith, and a lower portion, a linking column (30) slidably received in the first tube (21) of the control valve (20) and including an upper end portion fixedly attached to the lower portion of the drive member (27) to rotate and move therewith, and a lower end portion, and a follower (40) including a rod (42) having an upper end portion swivelably mounted in the lower end portion of the linking column (30) to move therewith and a lower end portion, and a coupling (43) fixedly mounted on the lower end portion of the rod (42) to move therewith and connected with the control gasket (45) for moving it.

A retaining cap (28) is mounted on the upper portion of the first tube (21) and includes an inner thread (282) threaded on an outer thread (211) formed on the first tube (21). A nut (26) is screwed onto an outer thread (250) formed on the second tube (25), and a washer (262) is mounted in an annular groove (261) contained in the nut (26).

The tubular lug (16) includes an upper end portion (17) formed with an outer thread (170) and containing a plurality of elongated slits (172), a mediate portion formed with an annular flange (171) and a lower end portion (18), and the end cap (10) includes an inner wall having an upper periphery formed with an inner thread (13) screwed on the outer thread (170) of the lug (16), and a lower periphery formed with an abutting flange (14) extending radially and inward, and the abutting flange (14) limits the travel on the lower end portion of the lug (16) between the top portion of the body (50) and the annular flange (171).

The drive member (27) includes a first drive rod (271) having an upper end portion secured to the end cap (10) and a lower end portion, and a hollow second drive rod (272) having an upper end portion retractably mounted on the lower end portion of the first drive rod (271) and a lower end portion secured in the linking column (30). The first drive rod (271) is connected to the second drive rod (272) by means of a ball (273).

The first drive rod (271) has a tetragonal cross-section and contains a threaded bore (274) in the upper end portion thereof, and the end cap (10) includes a protrusion (12) extending downward from the bottom portion thereof and containing a tetragonal recess (120) for receiving the upper end portion of the first drive rod (271), a countersunk bore (11) contained in the end cap (10) and connecting to the tetragonal recess (120), and a locking bolt (15) in turn extending through the countersunk bore (11) and screwed into the threaded bore (274).

The second drive rod (272) has a tetragonal cross-section, and the linking column (30) contains a tetragonal recess (31) in the upper end portion thereof for receiving the lower end portion of the second drive rod (272).

The lower end portion of the linking column (30) transversely contains a cylindrical cavity (33), longitudinally a channel (34) located under and connecting to the cavity (33), and a side passage (331) transversely contained in the lower end portion of the linking column (30) and connecting between the cavity (33) and the channel (34), and the rod (42) of the follower (42) is received in the channel (34) and includes a ball (41) formed on the upper end portion thereof and rotatably retained in the cavity (33).

Figure 5:
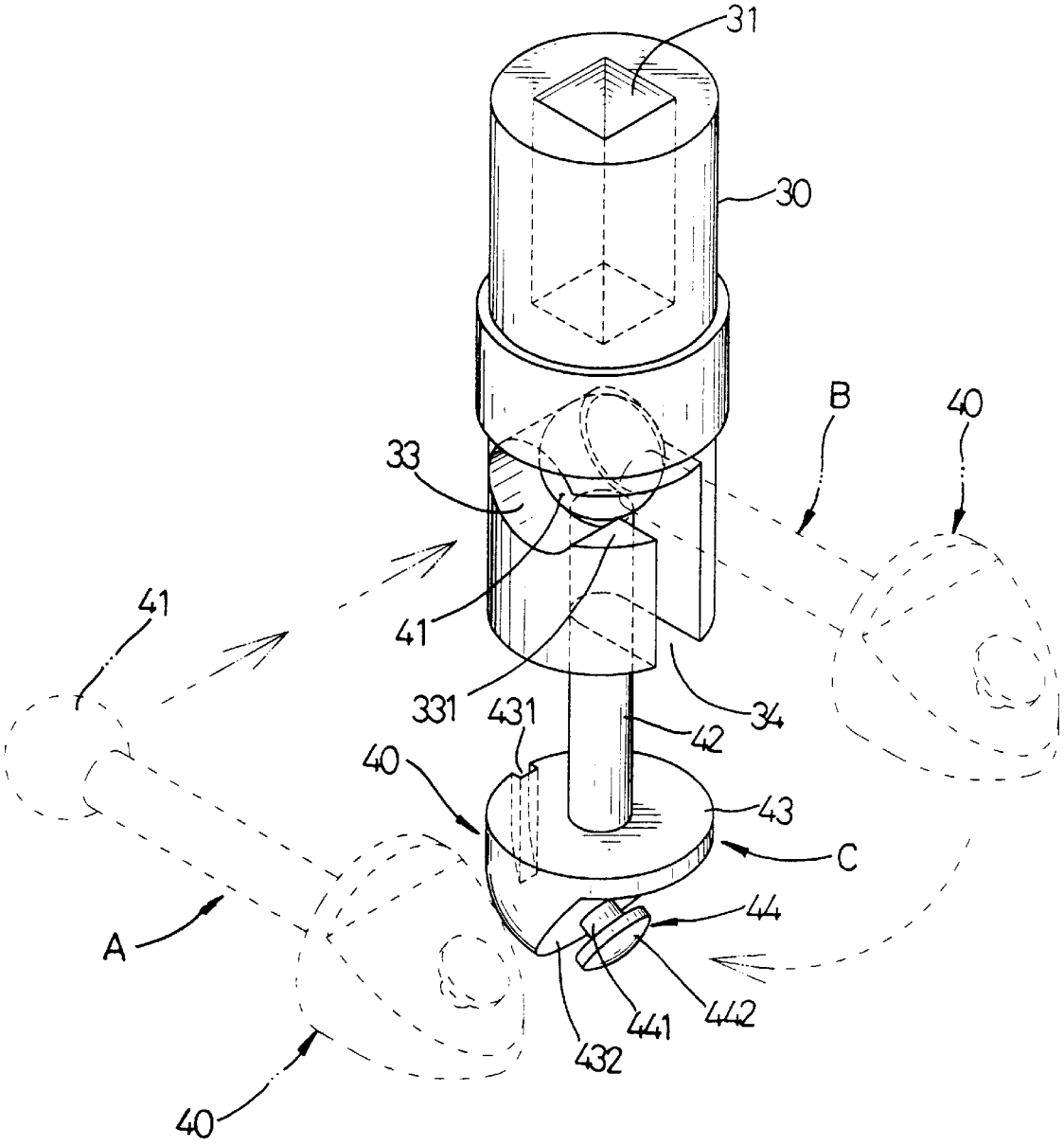
FIG. 5 is an operational view of a follower of the liquid container valve as shown in FIG. 4.

Especially referring to FIG. 5, the follower (40) initially placed at position (A) can be moved toward the linking column (30) to position (B) where the ball (41) is received in and retained by the cavity (33). The follower (40) can then be pivoted relative to the linking column (30) to position (C) where the rod (42) is received in the channel (34). In such a manner, the follower (40) does not rotate with the linking column (30) when it rotates. However, the follower (40) can be moved with the linking column (30) which it moves.

The control gasket (45) contains a first hole (450) formed in the upper portion thereof, and a second hole (451) formed in the mediate portion thereof and having a diameter greater than that of the first hole (450), and the coupling (43) of the follower (40) includes a bevel face (432) abutting the control gasket (45), and a plug (44) having a neck (441) extending from the bevel face (432) and received in the first hole (450), and an enlarged head (442) pressingly fitted into the second hole (451) of the control gasket (45).

The first tube (21) of the control valve (20) includes an elongate rib (22) longitudinally formed on the inner wall thereof, and the coupling (43) of the follower (40) contains a guide groove (431) for receiving the elongate rib (22) such that the follower (40) moves linearly in the first tube (21) of the control valve (20).

The control valve (20) includes an abutting plate (24) integrally formed on the mediate portion thereof to abutt the bottom portion of the body (50) and close the outlet hole (53). The abutting plate (24) contains an annular groove (241), and the control gasket (45) includes an annular lower portion (452) detachably inserted into the annular groove (241).

Figure 6:
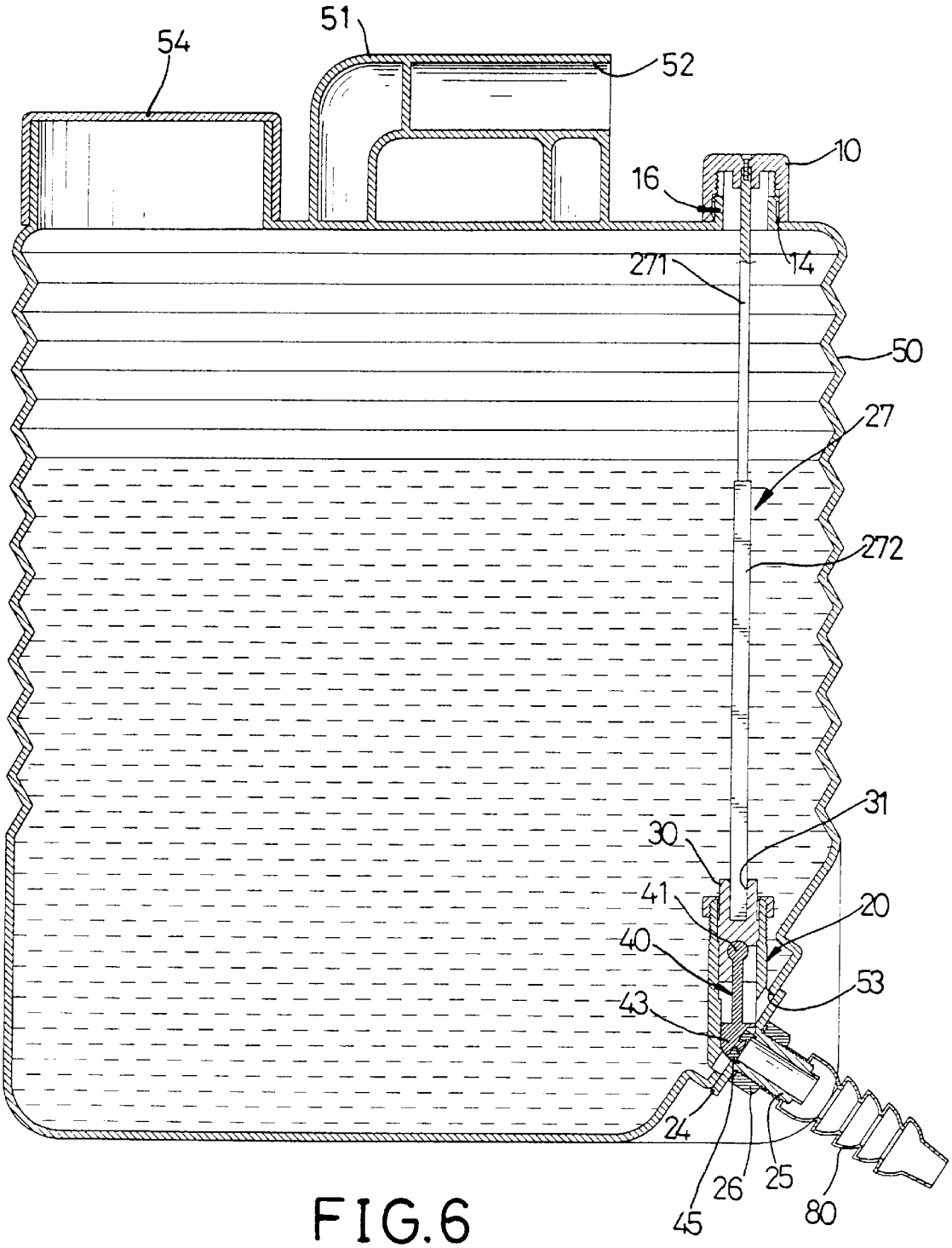
FIG. 6 is a front plan cross-sectional view of the liquid container as shown in FIG. 1, wherein a bellows pipe is attached to the liquid container.

In operation, referring to FIGS. 6–9 with reference to FIGS. 1–5, the bellows pipe (80) can be removed from the handle (51) to be fitted onto the second tube (25) of the control valve (20) as shown in FIG. 6.

Figure 7:
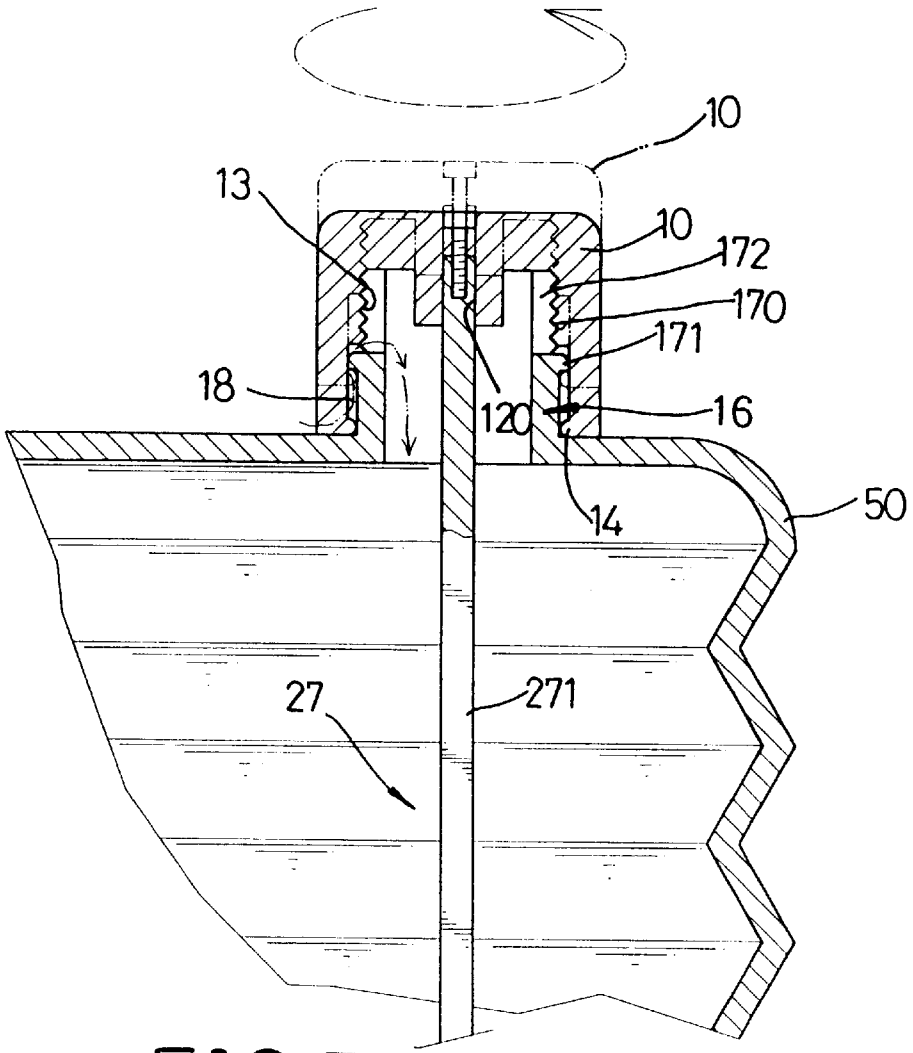
FIG. 7 is an operational view of the liquid container vent as shown in FIG. 6.
Figure 8:
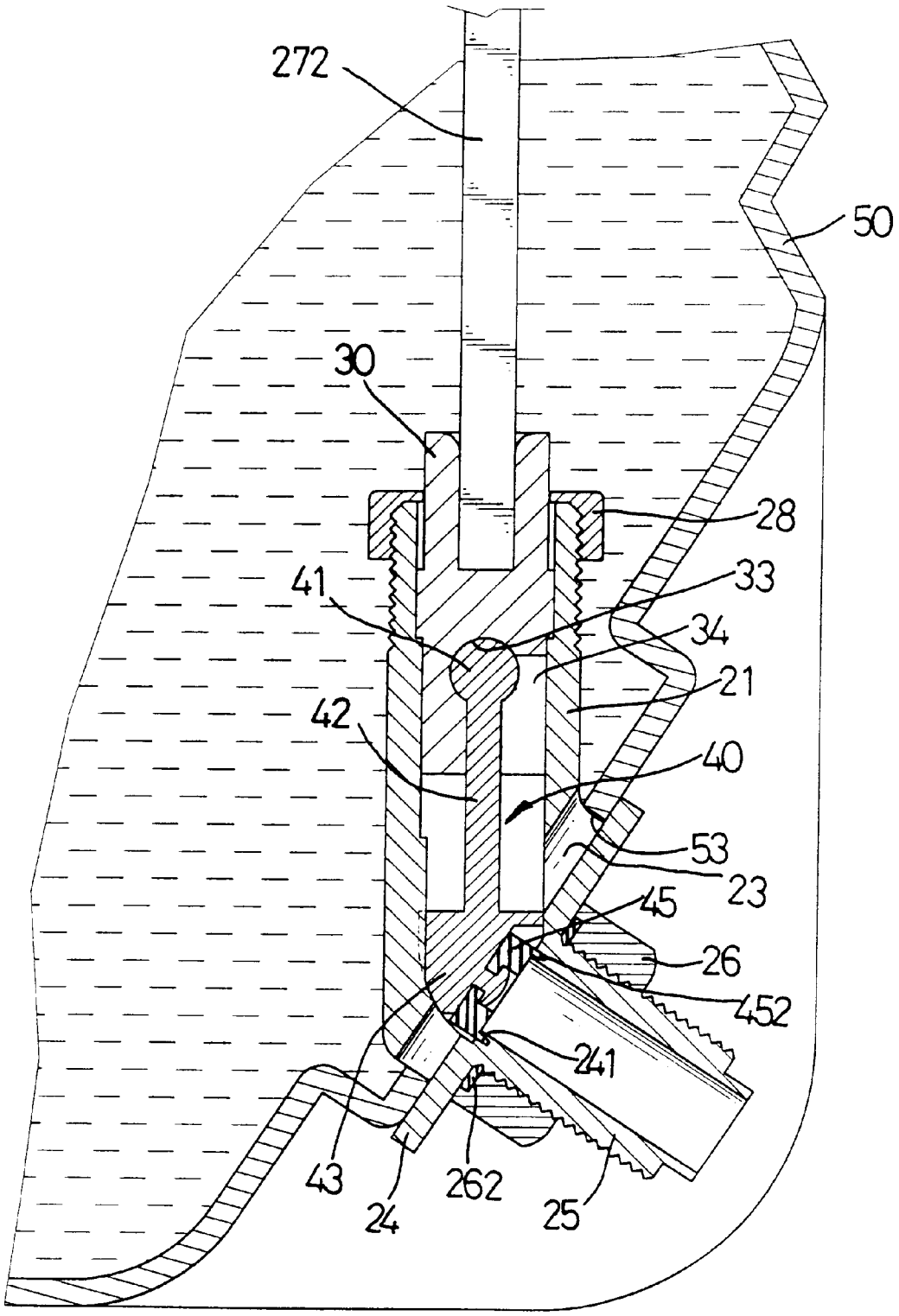
FIG. 8 is a front plan cross-sectional view of the liquid container valve as shown in FIG. 6 on a large scale.
Figure 9:
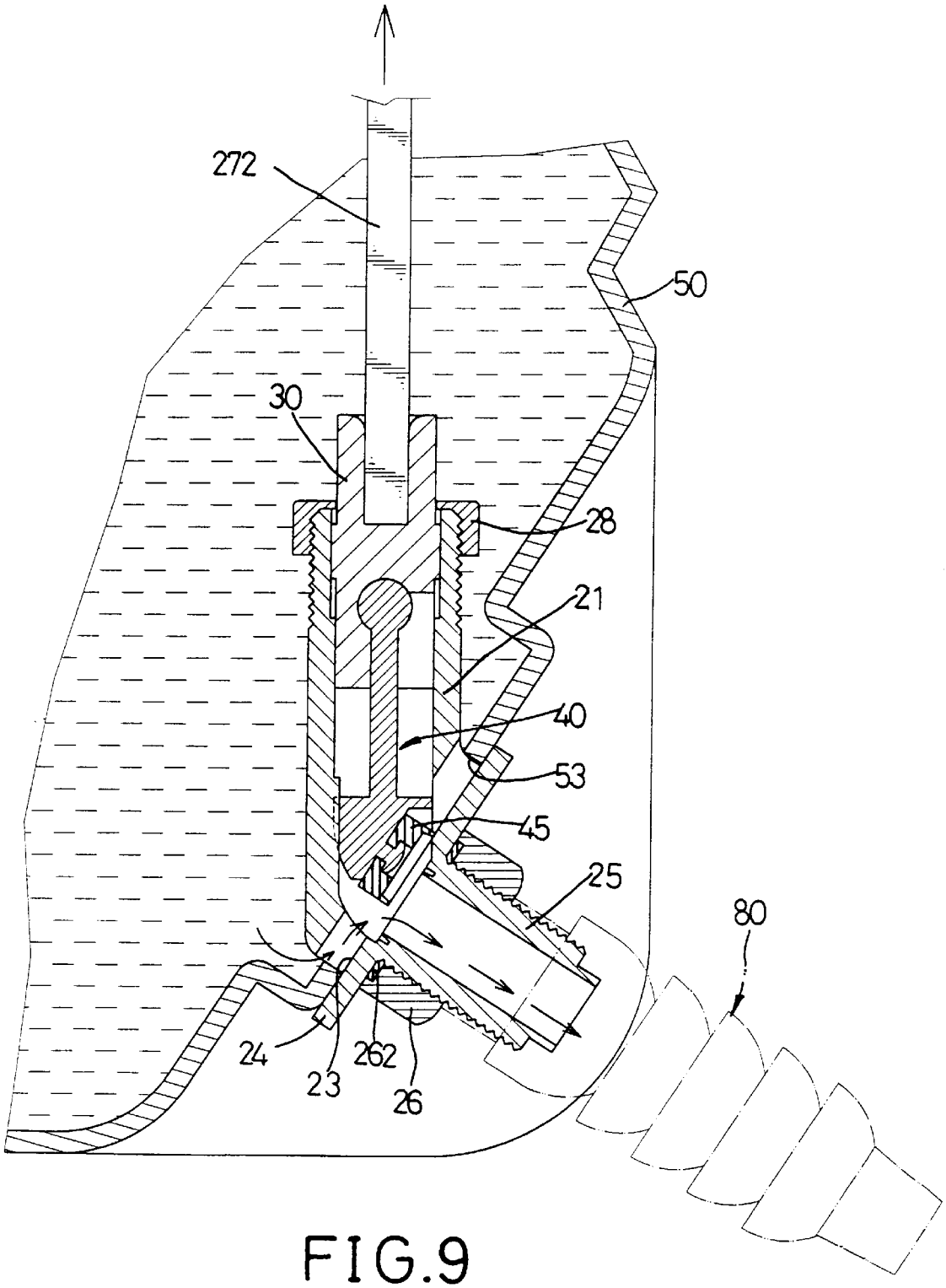
FIG. 9 is an operational view of the liquid container valve as shown in FIG. 8.

The end cap (10) can then be rotated relative to the tubular lug (16) to move upward from the position as shown in solid lines in FIG. 7 to the position as shown in phantom lines, thereby rotating and moving the drive member (27) upward which rotates and moves the linking column (30) upward which moves the follower (40) upward which in turn moves the control gasket (45) from the position as shown in FIG. 8 to the position as shown in FIG. 9, thereby connecting the body (50) with the second tube (25) of the control valve (20) via the drain holes (23) such that the liquid contained in the body (50) can be released into the second tube (25) of the control valve (20) along the direction as indicated by the arrows, and can then be conveyed into the bellows pipe (80) for usage of the user.

Figure 10:
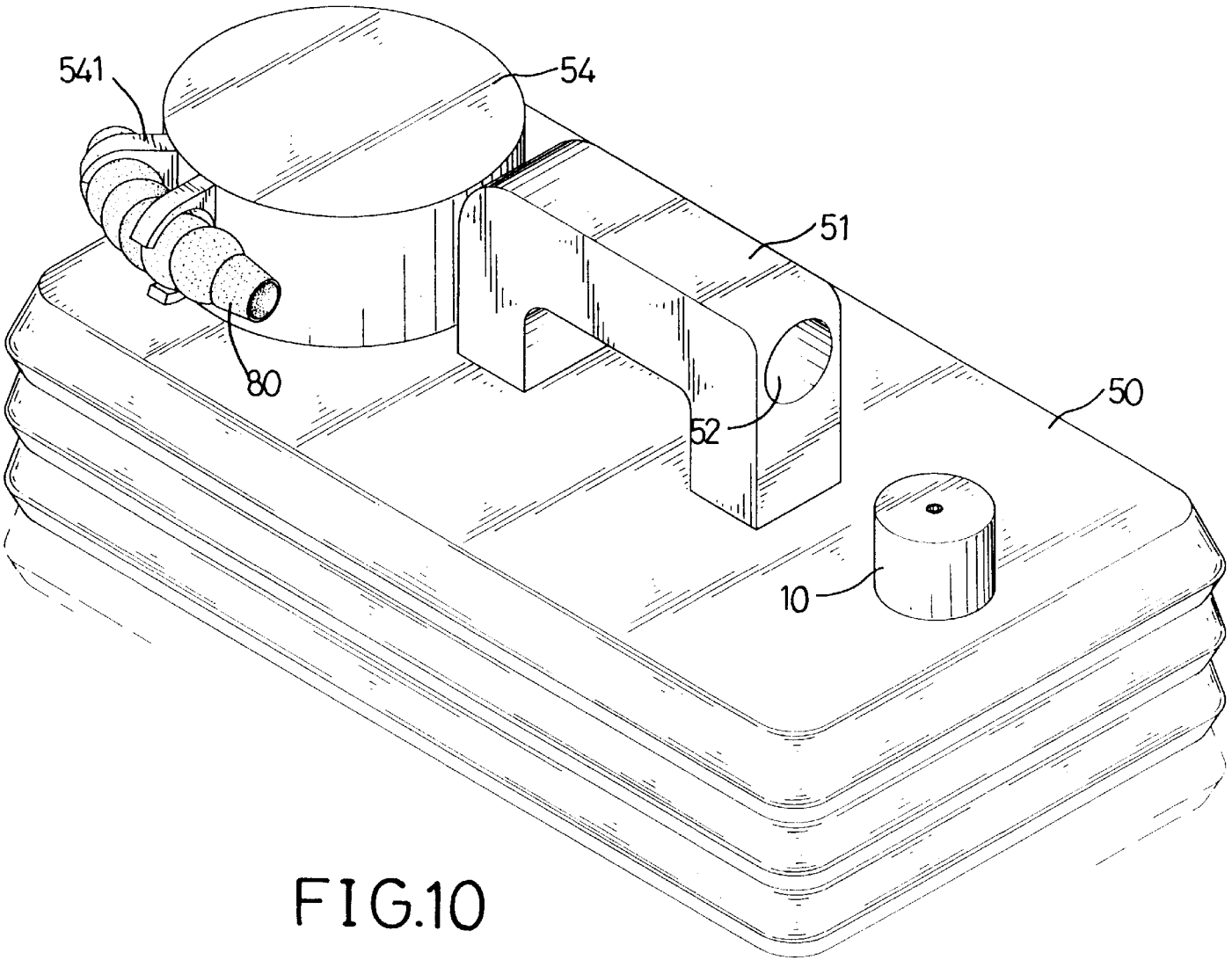
FIG. 10 is a perspective view of the liquid container as shown in FIG. 1 on a large scale.

Referring to FIG. 10, a liquid inlet cap (54) is mounted on the top portion of the body (50) and includes two clips (541) for retaining the bellows pipe (80).

Figure 11:
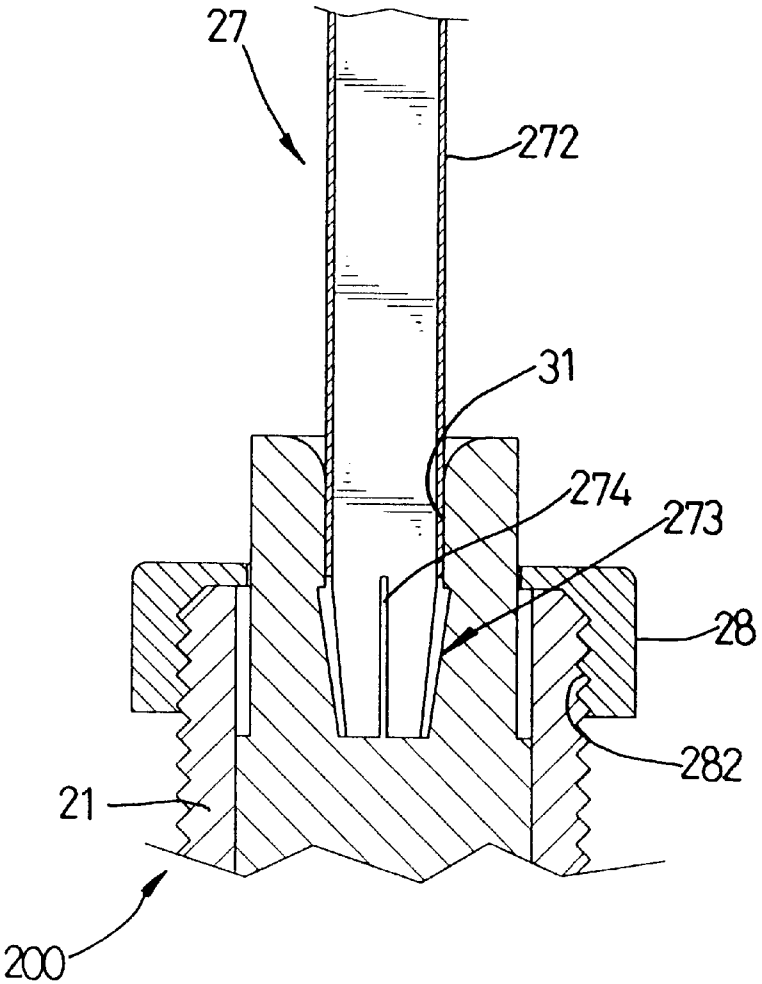
FIG. 11 is a front plan cross-sectional view of a drive member of the liquid container in accordance with another embodiment of the present invention.

Referring to FIG. 11, in accordance with another embodiment of the present invention, the second drive rod (272) is formed with a cone-shaped head (273) received in the recess (31), with a plurality of slits (274) contained in the cone-shaped head (273).

It should be clear to those skilled in the art that further embodiments may be made without departing from the scope and spirit of the present invention.

What is claimed is:

1. A liquid container comprising:

a hollow body (50) containing a vent hole (56) formed in the top portion thereof, and an outlet hole (53) formed in the bottom portion thereof;

a substantially V-shaped control valve (20) mounted in the bottom portion of said body (50) and including a first tube (21) received in said body (50) and a second tube (25) extending outward from said body (50) via said outlet hole (53), and a plurality of drain holes (23) contained in the mediate portion of said control valve (20) and connecting between the inside of said body (50) and said second tube (25);

a control gasket (45) movably mounted in said control valve (20) and movable between a first position where said control gasket (45) seals each of said drain holes (23), thereby closing the connection between the inside of said body (50) and said second tube (25), and a second position where said control gasket (45) is released from said drain holes (23), thereby opening the connection between the inside of said body (50) and said second tube (25); and drive means for moving said control gasket (45) between said first position and said second position, said drive means comprising;

a tubular lug (16) fixedly mounted on the top portion of said body (50) and connecting to said vent hole (56);

an end cap (10) rotatably mounted on said lug (16) and movable relative to said lug (16);

a drive member (27) movably received in said body (50) and having an upper portion and a lower portion, said upper portion secured to said end cap (10) to rotate and move therewith;

a linking column (30) slidably received in said first tube (21) of said control valve (20) and having an upper portion and a lower portion, said upper end portion fixedly attached to said lower portion of said drive member (27) to rotate and move therewith; and a follower (40) including a rod (42) having an upper end portion and a lower end portion, said upper end portion swivelably mounted in said lower end portion of said linking column (30) to move therewith, and a coupling (43) fixedly mounted on said lower end portion of said rod (42) to move therewith and connected with said control gasket (45) for moving said control gasket (45).

2. The liquid container in accordance with claim 1, wherein said tubular lug (16) includes an upper end portion (17) formed with an outer thread (170), an annular flange (171) formed on a mediate portion and a lower end portion (18), and said end cap (10) includes an inner wall having an upper periphery formed with an inner thread (13) screwed on said outer thread (170) of said lug (16), and a lower periphery formed with an abutting flange (14), extending radially and inward, and said abutting flange (14) limits the travel on said lower end portion of said lug (16) between the top portion of said body (50) and said annular flange (171).

3. The liquid container in accordance with claim 1, wherein said drive member (27) includes a first drive rod (271) having an upper end portion secured to said end cap (10) and a lower end portion, and a hollow second drive rod (272) having an upper end portion retractably mounted on said lower end portion of said first drive rod (271) and a lower end portion secured in said linking column (30).

4. The liquid container in accordance with claim 1, wherein said first drive rod (271) has a tetragonal cross-section and contains a threaded bore (274) in the upper end portion thereof, and said end cap (10) includes a protrusion (12) extending downward from the bottom portion thereof and containing a tetragonal recess (120) for receiving said upper end portion of said first drive rod (271), a countersunk bore (11) contained in said end cap (10) and connecting to said tetragonal recess (120), and a locking bolt (15) extending through said countersunk bore (11) and screwed into said threaded bore (274).

5. The liquid container in accordance with claim 3, wherein said second drive rod (272) has a tetragonal cross-section, and said linking column (30) contains a tetragonal recess (31) in the upper end portion thereof for receiving said lower end portion of said second drive rod (272).

6. The liquid container in accordance with claim 1, wherein said lower end portion of said linking column (30) transversely contains a cylindrical cavity (33) and longitudinally contains a channel (34) located under and connecting to said cavity (33), and a side passage (331) transversely contained in said lower end portion of said linking column (30) and connecting between said cavity (33) and said channel (34), and said rod (42) of said follower (42) is received in said channel (34) and includes a ball (41) formed on the upper end portion thereof and rotatably retained in said cavity (33).

7. The liquid container in accordance with claim 1, wherein said control gasket (45) contains a first hole (450) formed in the upper portion thereof, and a second hole (451) formed in the mediate portion thereof and having a diameter greater than that of said first hole (450), and said coupling (43) of said follower (40) includes a bevel face (432) abutting said control gasket (45), and a plug (44) having a neck (441) extending from said bevel face (432) and received in said first hole (450), and an enlarged head (442) received in said second hole (451).

8. The liquid container in accordance with claim 1, wherein said first tube (21) of said control valve (20) includes an elongate rib (22) longitudinally formed on the inner wall thereof, and said coupling (43) of said follower (40) contains a guide groove (431) receiving said elongate rib (22).

9. The liquid container in accordance with claim 1, wherein said control valve (20) includes an abutting plate (24) formed on the mediate portion thereof and abutting the bottom portion of said body (50) to close said outlet hole (53).

10. The liquid container in accordance with claim 9, wherein said abutting plate (24) contains an annular groove (241), and said control gasket (45) includes an annular lower portion (452) detachably inserted into said annular groove (241).

11. The liquid container in accordance with claim 1, further comprising an inverted U-shaped handle (51) mounted on the top portion of said body (50) and transversely containing a storage chamber (52), and a bellows pipe (80) releasably received in said storage chamber (52).

* * * * *